United States Patent [19]

Oexler et al.

[11] Patent Number: 4,662,166

[45] Date of Patent: May 5, 1987

[54] DRIVE APPARATUS FOR A PARAFFINING DEVICE

[75] Inventors: Rudolf Oexler, Ingolstadt; Willi Hackenberg, Eichstätt, both of Fed. Rep. of Germany

[73] Assignee: Schubert & Salzer Maschinenfabrik Aktiengesellschaft, Ingolstadt, Fed. Rep. of Germany

[21] Appl. No.: 746,959

[22] Filed: Jun. 20, 1985

[30] Foreign Application Priority Data

Jun. 20, 1985 [DE] Fed. Rep. of Germany ..... 3422814

[51] Int. Cl.[4] ..... B05C 1/06; D01H 13/30; D01H 7/882

[52] U.S. Cl. ..... 57/296; 57/105; 57/400; 118/78

[58] Field of Search ..... 57/295, 296, 104, 400, 57/105; 118/78, 77; 427/11

[56] References Cited

U.S. PATENT DOCUMENTS

| | | | |
|---|---|---|---|
| 1,799,896 | 4/1931 | Graveline | 57/105 |
| 3,358,641 | 12/1967 | Gfeller | 118/78 |
| 3,479,988 | 11/1969 | Trost et al. | 118/78 |
| 3,511,045 | 5/1970 | Bures et al. | 57/407 |
| 3,590,568 | 7/1971 | Kubovy | 57/295 |
| 3,690,576 | 9/1972 | Schroeder | 242/18 DD |
| 3,802,382 | 4/1974 | Koller | 118/78 |
| 4,046,102 | 9/1977 | Piro | 118/78 |
| 4,345,542 | 8/1982 | Hauner | 118/78 |
| 4,501,221 | 2/1985 | Landwehrkamp et al. | 118/78 |

*Primary Examiner*—Stuart S. Levy
*Assistant Examiner*—Joseph J. Hail, III
*Attorney, Agent, or Firm*—Julian W. Dority

[57] ABSTRACT

Disclosed is a drive apparatus for a device for applying paraffin wax to yarn. In the device, a solid block of paraffin is mounted on a polyhedral bolt which is driven by a whorl or drive pulley. The whorl, in turn, is driven by a continuous drive belt. Advantageously, a plurality of similar devices are mounted on the same open-end spinning machine so adjacent devices may be driven from the same drive belt. Bracing elements hold the yarn against the rotating face of the paraffin block of each device to ensure uniform application of paraffin.

25 Claims, 5 Drawing Figures

35
18
17
12
10
16
1
15
1
1
1
E
1
1
2
1
21
31
36
33
3
34
30
32
11
19
13
14

DRIVE APPARATUS FOR A PARAFFINING DEVICE

FIELD OF THE INVENTION

This invention relates to a drive apparatus for a paraffining device of a textile machine which includes a plurality of similar paraffining devices, each of which has a rotary polyhedral bolt to receive a solid paraffin block, against which a yarn to be paraffined is braced.

BACKGROUND OF THE INVENTION

The solid paraffin block is generally set in rotation by the yarn supplied to a spooling apparatus (German Utility Model 7,611,630). However, in this case, there is a danger of the yarn cutting into the paraffin block and thus making a uniform removal of the paraffin impossible. In many cases, an individual drive motor is provided for each paraffining device for this reason (German Offenlegungsschrift 2,316,452). However, this renders such a drive system extremely onerous.

It has also become known to drive, by means of a central shaft extending across a plurality of similar paraffining devices, via complicated intermediate transmissions, individual drive units which then, in turn, drive the individual paraffining devices (French Pat. No. 1,293,729, German Pat. No. 1,560,460, and German OffenLegungsschrift No. 2,227,308). These individual drive units are onerous. Moreover, in the case of a friction wheel transmission, the transmission of the drive becomes progressively unreliable with increasing wear of the friction wheels, so that correct paraffining of the yarn is no longer ensured.

SUMMARY OF THE INVENTION

The object of the invention is to develop a simple and reliable drive apparatus for a paraffining device.

This object is achieved according to the invention when each polyhedral bolt is connected to a drive whorl with which a continuous drive belt cooperating with a plurality of adjacent paraffining devices is in engagement. Such a drive means is extremely simple. Furthermore, this drive means has been found totally reliable even at the low rotary speeds which are desired for the paraffin block, so that uniform paraffining of the yarn is ensured for a long time.

Common belt drive systems for a plurality of similar elements of a textile machine are in fact already known, but only for fast-running elements, such as spindles, spinning rotors and loosening rollers of open-end spinning machines (German Auslegeschrift No. 1,818,034). At these high speeds, minor fluctuations in the countertorque influencing the driven element have no effect, so that a uniform drive is assured. At low rotary speeds on the other hand, such fluctuations cause rotary speed variations. However, it has been discovered unexpectedly that satisfactory paraffining of the yarn is ensured in spite of the possible occurrence of these rotary speed fluctuations.

For the purpose of this invention, the term "drive belts" is to be understood to mean not only flat belts, but to brace all elongated drive elements such as round cords, v-belts, toothed belts, etc.

In order to optimize the drive means further without the need for separate belt tensioning elements, in a further development of the invention, the drive belt is passed zig-zag fashion about the drive whorls of the adjacent paraffining devices. The drive belt associated with these paraffining devices in common is, therefore, in driving association with the drive whorls of these paraffining devices alternately on the one and on the other side of the common surface upon which the polyhedral bolts of these paraffining devices are located. The common surface in this case may be a plane or (in the case of an inclined arrangement of the paraffining devices on circular machines) also a conical shape.

In the case of a textile machine constructed as an open-end spinning machine which exhibits a plurality of mutually juxtaposed open-end spinning apparatuses and a shaft to control the fiber delivery into these open-end spinning apparatuses, the drive belt is conveniently in driving association with the shaft. This shaft to control the yarn delivery is driven as a function of the through put of fiber through the open-end spinning apparatuses, so that the paraffining devices are adapted to this throughout and are, therefore, always driven only at a speed necessary for this throughput. An extremely long duty life of the drive means for the paraffining devices is achieved in this way.

A particularly structurally simple mode of construction of the subject of the invention is made possible if the drive whorl of each paraffining device is arranged between a bracket for this paraffining device and the paraffin block. This also results in particularly good accessibility to this drive means. A further reduction of the structural outlay is also achieved if the polyhedral bolt is constructed integrally with the drive whorl. In order to facilitate the assembly and also to economize the weight of the paraffining devices to be driven, the polyhedral bolt is conveniently constructed as a hollow body which accommodates the bearing means and fastening means. According to a simple structural development of the subject of the invention, the fastening means exhibits a screw-threaded bolt which is engaged in a screwthreaded bushing provided in the bracket. The cavity of the polyhedral bolt is advantageously closable at its end remote from the bearing means by a cap which overhangs the external circumference of the polyhedral bolt and is constructed as a stop for a resiliently stressed paraffin support plate mounted on the polyhedral bolt. For this purpose, the plate advantageously has corners which overhang the polyhedral bolt at its beveled edges; whereas, the lateral surfaces of the polyhedral bolt and of the cap are flush, while the paraffin support plate exhibits guide surfaces adapted to the profile of the polyhedral bolt. It is thus achieved that the paraffin block can be pushed up onto the polyhedral bolt past the insert serving as a stop for the paraffin support plate, without the need to increase the play between polyhedral bolt and paraffin block for this purpose.

In a textile machine in which the drive belt is returned along the driven paraffining devices to the drive station, a bracing element is preferably provided for the return side of the drive belt. In a machine in which the paraffining device is preceded by a spooling apparatus, which is in turn preceded by a yarn tension compensating element extending from the bracket to the above drive whorl, this bracing element is then advantageously arranged close beneath this yarn tension compensating element, so that the drive belt is protected by this covering. According to a preferred method of construction of the apparatus according to the invention, the bracing element serves as a support of a stop limiting the feed movement of the paraffin block.

As a further development of such a construction, a support constructed as a bracing element is arranged on each of the two sides of the paraffin block, while the stop extends from one of these supports to the other support. In this case, the bracing element, which is arranged in front of the paraffin block relative to its rotary movement influencing the stop, is conveniently constructed as a pivot bearing for the stop; whereas, the bracing element arranged behind the paraffin block exhibits a longitudinal slot on its side remote from the parafinning device to receive the end of the stop. With this arrangement, it is ensured that in spite of the extremely simple bearing means of this stop, the latter cannot be pivoted by the rotating paraffin block out of the longitudinal slot serving as a housing.

In order to protect and cover the return side of the drive belt, it may be provided with a duct open on its side facing the paraffining device, which as an advantageous further development of the subject of the invention is formed by the bracket and a cover bar which is an integral component of the yarn tension compensating element.

In order to avoid the necessity of making the paraffin block run always at the maximum speed, which is only necessary under quite specific operating conditions, it is preferably provided according to the invention that the rotary speed of the paraffin block is adapted to the fibrous mass supplied to the open-end spinning apparatus. As already mentioned, this is preferably done by taking the drive of the paraffin blocks directly from the shaft carrying the delivery rollers, however, another (electrical, for example) mode of speed coupling is likewise possible in principle.

The invention produces a simple apparatus, which is compact, requires little energy for the drive of the paraffin blocks and which operates reliably with no outlay for maintenance. In spite of a small mechanical engineering outlay, the apparatus has a long life and is convenient to operate.

DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
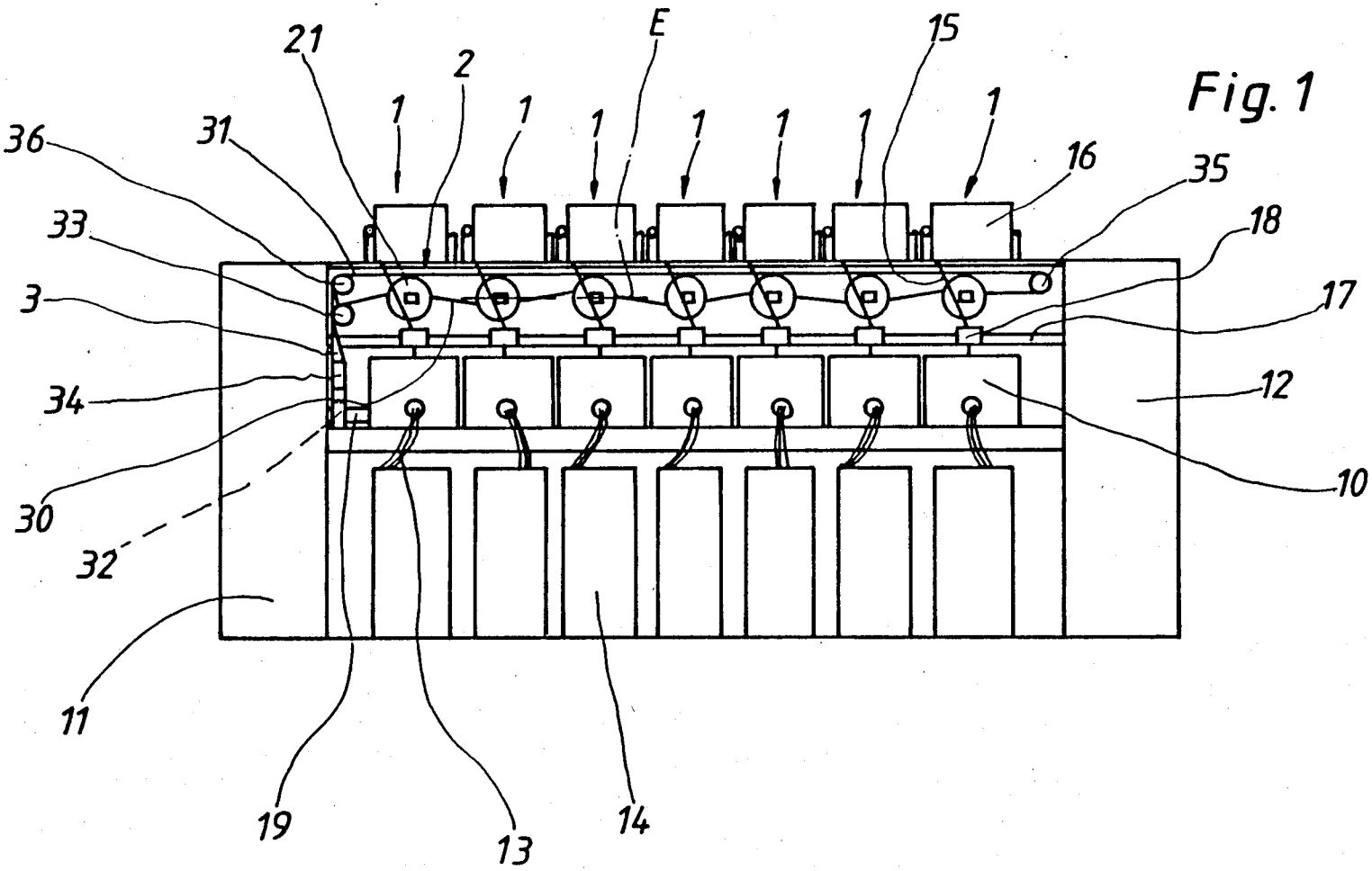
FIG. 1 shows an open-end spinning machine with the apparatus according to the invention in elevation.

The invention may find application on various textile machines on which the yarn can be paraffined. Such textile machines may exhibit an elongated or also a circular shape. It is also irrelevant whether they are yarn-producing spinning machines, yarn-treating spooling machines, or yarn-processing machines (knitting or hosiery machines). An open-end spinning machine (FIG. 1), which exhibits a plurality of spinning stations 1, and also accordingly of paraffining devices 2, has been selected as an example for the following discussion. The spinning machine shown exhibits seven spinning stations 1, however, this number is considerably larger in practice. The spinning machine itself is only illustrated diagrammatically, all those elements which are not absolutely necessary to an understanding of the invention having been omitted for the sake of clarity. The open-end spinning machine has an end frame 11 and 12 at each of its ends. Between the end frames 11 and 12, the spinning machine exhibits, for each spinning station 1, a spinning apparatus covered by a cover 10. The fibrous material 13, which is presented to the spinning apparatus in a spinning can 14, is supplied to the former by means of a delivery apparatus which is driven by a shaft 19 extending along the total length of the machine.

The yarn 15 spun in the spinning apparatus is doffed by means of doffing rollers 17 and 18 and wound onto a spool 16, the yarn 15 being presented traversing to the spool 16 in customary manner and therefore not shown. A paraffing device 2 is arranged in the yarn path between the doffing rollers 17 and 18 and the spool 16 (or a yarn-processing station in yarn-processing machines).

Each paraffining device 2 has a polyhedral bolt 4 (FIG. 3) upon which a paraffin block 21 to paraffin yarn 15 is plugged. The polyhedral bolt 4 is in driving association with a drive whorl 20. The drive whorls 20 of the paraffining devices 2 of a plurality of mutually juxtaposed spinning stations 1 are driven by a common drive belt 3.

In principle, the drive belt 3 may always contact the drive whorls 20 (FIG. 2) of the paraffining device 2 on one and the same side, in which case the drive belt 3 is maintained tensioned and in contact with the drive whorls 20 by customary tensioning rollers, not shown. In this way, the paraffin blocks 21 are driven uniformly. Even if, due to the yarn tension variation, the torque exerted by the yarn 15 upon the paraffin block 21 varies briefly, nevertheless, this does not cause such a pronounced rotary speed variation as might prejudice a correct paraffining of the yarn 15. On the contrary, it has been discovered that the paraffining of the yarn 15 and the wearing away of the paraffin blocks 21 occurs with great uniformity.

A particularly advantageous method of construction of the apparatus, wherein the drive belt 3 wraps the drive whorls 20 (FIG. 2) in zig-zag fashion, is described below with reference to FIG. 1. As indicated in the case of two spinning stations 1, the axes of the paraffining devices 2 are located on a common surface E, whereas, the driving side 30 is in driving association with the drive whorls 20 (FIG. 2) of the paraffining devices 2 alternately on the one and other side of this surface E. In this manner, every second paraffin block 21 is driven clockwise, whereas, the paraffin blocks 21 located between them are driven counterclockwise. However, this is irrelevant to the paraffining of the yarn 15, which is paraffined equally well irrespective of the direction of rotation of the paraffin block 21.

Depending upon the type of machine, this surface E is either a plane (in the case of elongated machines and of circular machines in which the axes of the paraffining devices 2 extend precisely radially outwards) or else a conical surface (in the case of circular machines in which the axes of the paraffining devices 2 are arranged inclined).

The drive belt 3 is maintained taut by its zig-zag passage and wraps the drive whorls 20 over a greater region than for customary tangential drives, so that good entrainment of the drive whorls 20 is achieved by this means, while tensioning rollers are eliminated.

In principle, the drive of the drive belt 3 may also occur in any desired manner. According to FIG. 1, the drive belt 3 receives its drive from the shaft 19 by which the fibrous material 13 is supplied to the spinning apparatus. For this purpose, a drive pulley 32 is arranged on the shaft 19 near the end frame 11. Between this drive pulley 32 and a return pulley 33 for the driving side 30, to deviate the drive belt 3 towards the running axis of the machine, a further return pulley 34 is present, by which the drive belt 3 is fed to the return pulley 33 at the optimum angle. As already described, the drive belt 3 contacts the drive whorls 20 of the paraffining devices 2 alternately from above and from below. At the other end of the machine, the drive belt 3 is returned by a further return pulley 35 near the end frame 12. The return side 31 of the drive belt 3 is then guided back above the paraffining devices 2 to return pulley 36 near the end frame 11, from where the drive belt 3 passes to the drive pulley 32 again.

The following procedure is adopted in order to apply the drive belt to the drive whorls 20:

At first, the drive belt 3 is applied to the drive pulley 32 and to the return pulleys 34, 33, 36, and 35, without the drive belt 3 being immediately passed over the drive whorls 20. The drive belt 3 is then placed alternatively above and beneath a polyhedral bolt 4 (FIG. 3) connected to the drive whorl 20. Because the drive belt 3 is then deviated only slightly by the zig-zag position about the polyhedral bolts 4 of the paraffining devices 2, it is only slightly taut. This drive belt 3 is now applied to the drive whorls 20. The zig-zag configuration of the drive belt 3 is thereby intensified, so that the drive belt 3 acquires its operational tension.

The drive of the drive belt 3 from the shaft 19 of the feed apparatus of the open-end spinning machine causes the paraffin blocks 21 to be driven at a speed adapted to the throughput of the fiber. In fact, if much sliver is supplied to the open-end spinning apparatuses, so that the throughput of fiber is high, then the rotary speed of the paraffin blocks 21 also increases correspondingly. If less sliver is supplied to the spinning apparatuses, then the rotary speed of the paraffin blocks 21 is also decreased correspondingly, so that the paraffin blocks 21 are always driven only at the required rotary speed and no faster. This results in a longer useful life of the drive means of the paraffining devices 2.

A particularly advantageous method of construction of the drive apparatus, and of the correspondingly constructed paraffining device 2, is described below with references to FIGS. 2 and 3. In this case, the said device is supported by a bracket 5 constructed as a retaining plate. For this purpose, a screwthreaded bushing 40 in which a screwthreaded bolt 41 is engaged, is pressed in, or otherwise firmly connected, to the retaining plate 5. Two rolling-contact bearings 42 and 43, upon which the polyhedral bolt 4 is mounted for rotation, are positioned on the screwthreaded bolt 41. The polyhedral bolt 4 is constructed as a hollow body, which has the advantage that the screwthreaded bolt 41 is accessible from the front side of the polyhedral bolt 4 on the one hand, and reduces the weight of the paraffining device 2, and therefore contributes to prolonging its duty life on the other hand.

The polyhedral bolt 4 exhibits a polyhedral profile 400, upon which a paraffin support plate 44 is mounted sliably by a guide section 440 which exhibits a guide surface 441 adapted to the polyhedral profile 400. At the end of this guide section 440 remote from the drive whorl 20, the paraffining support plate 44 merges into a radial support surface 442 which is bounded by an annular collar 443 which overhangs this support surface 442 axially on its side remote from the drive whorl 20.

The drive whorl 20 is connected to the polyhedral bolt 4 only by a radial connecting surface 200, so that an annular recess 45 to accommodate a compression spring 46 is formed between the drive whorl 20 and the polyhedral bolt 4. This compression spring 46, which is braced against the radial connecting surface 200 on the one hand and against the radial support surface 442 on the other hand, stresses the paraffin support plate 44 towards the free end of the polyhedral bolt 4, and thus ensures that the paraffin block 21 always projects to the prescribed degree into the yarn path plane, so that it contacts the yarn 15 in a desired manner. The paraffin block 21 is meanwhile retained in this position counter to the action of the compression spring 46 by a stop 6, which will be described more fully later.

As previously mentioned, the polyhedral bolt 4 is constructed as a hollow body. A cylindrical shoulder 470 of a cap 47 (FIG. 4) protrudes into the open end of the polyhedral bolt 4 remote from the drive whorl 20. This cylindrical shoulder 470 serves to fasten the cap 47 in the polyhedral bolt 4. This may be effected by cooperating catches or by an appropriately tight fit between these parts.

Figure 4:
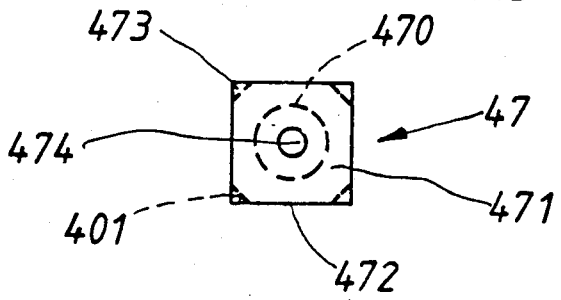
FIG. 4 shows a detail from FIG. 3 in elevation.

The cap 47 exhibits a stop surface 471, by which it contacts the end face of the polyhedral bolt 4. As FIG. 4 shows, the lateral surfaces 472 of the cap are flush with the lateral surfaces of the polyhedral bolt 4. The edges of the polyhedral bolt 4 are provided with bevels 401, contrary to the edges of the stop surface 471 of the cap 47. Consequently, the corners 473 overhang these bevels 401. As already mentioned, the guide surface 441 of the paraffin support plate 44 is adapted to polyhedral profile 400 of the polyhedral bolt 4 and, therefore, likewise has surfaces corresponding to the bevels 401 of the polyhedral bolt 4. The corners 473 of the cap 47 therefore form a stop for the paraffin support plate 44 and retain the latter reliably upon the polyhedral bolt 4.

Because the lateral surfaces 472 of the cap 47 terminate flush with the lateral surfaces of the polyhedral bolt 4, the cap 47 does not in any way obstruct the pushing of a paraffin block 21 onto the polyhedral bolt 4, nor does it interfere with its sliding on the polyhedral bolt 4.

The cap 47 has a central bore 474 which permits access to the screwthreaded bolt 41 without the need to remove the cap 47 out of the polyhedral bolt 4. This facilitates a rapid dismantling of the paraffining device 2, if this should ever be necessary.

In the apparatus, the construction of which is described above, the drive whorl 20 of the paraffining device 2 is located between the bracket 5 for the paraffining device 2 and the paraffin block 21. However, this is not a necessary condition, as will be described later with reference to FIG. 5.

In the example of construction illustrated, the drive belt 3 is returned along the driven paraffining devices 2 to the drive station (shaft 19, see FIG. 1). The drive belt 3 is maintained taut so that the two sides 30 and 32 do not touch each other. In order to ensure this, even in the case of long machines in which a large number of paraffining devices 2 are driven by this drive belt 3, according to FIGS. 2 and 3 bracing elements 60 and 61 are provided for the return side 31 of the drive belt 3 which is out of engagement with the paraffining devices 2. It is sufficient in principle if only one bracing element 60 or 61 is provided for each paraffining device 2, indeed, it is not even necessary for each paraffining device 2 to have such a bracing element 60 and/or 61.

Figure 2:
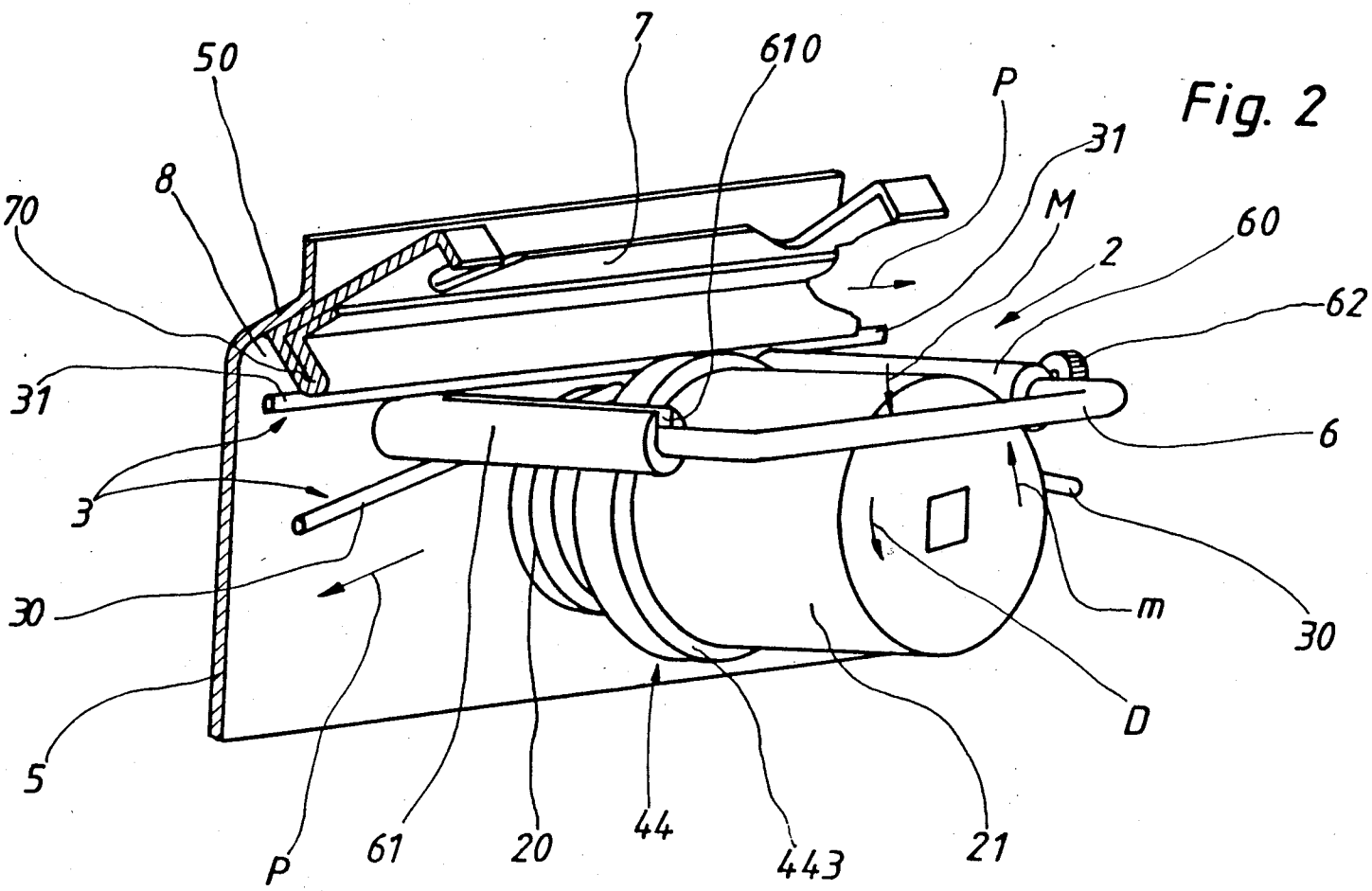
FIG. 2 shows a paraffining device driven according to the invention in a perspective view.

According to FIG. 2, the bracing element 60 is constructed as support of the stop 6 limiting the feed movement of the paraffin block 21. For this purpose again, a single such bracing element 60 for each paraffining device 2 is sufficient. However, since it has been discovered that a particularly uniform wearing away of the paraffin block 21 is achieved if the stop 6 extends transversely to the yarn path, according to FIG. 2, such a bracing element 60 and 61 constructed as a support for the stop 6 is provided on each of the two sides of the paraffin block 21. In this case, the stop 6 extends from one bracing element 60 to the other bracing element 61 of such a pair of bracing elements.

The stop 6 may in principle be connected rigidly to both bracing elements 60 and 61. However, in the example of construction illustrated, a clamp screw 62 is provided only for the bracing element 60. The bracing element 61 on the other hand, exhibits a longitudinal slot 610 to accommodate the other end of the stop 6 on its upper side—that is to say, on its side remote from the polyhedral bolt 4 of the paraffining device 2. It is therefore possible, after releasing the clamp screw 62, to pivot the rail-shaped stop 6 into and out of the operative position in the bracing element 61, which forms a pivot bearing, so that the exchange of the paraffin block 21 and its subsequent securing upon the polyhedral bolt 4 can be accomplished in the simpliest and quickest manner.

In the example of construction illustrated in FIGS. 1 and 2, the yarn 15 to be paraffined is moved from below upwards (see arrow B in FIG. 3). The stop 6 is located on the yarn departure side of the paraffin block 21. For the presecribed direction of movement of the drive belt 3 (see arrow P), the paraffin block 21 rotates counterclockwise in the direction of the arrow D. The rotary movement influencing the stop 6, therefore, passes from right to left. The bracing element 60, which is constructed as a pivot bearing for the stop 6, is arranged in front of this paraffin block relative to this rotary movement. The bracing element 61 exhibiting the longitudinal slot 610 is accordingly arranged behind the paraffining device 2. Thus, the rotating paraffin block 21 causes the stop 6 to be pressed into the longitudinal slot 610, and thus secures the stop 6 in its operative position. The reason for this is that, although the stop 6 is influenced by two mutually opposite torques M and m, nevertheless the torque M, which exhibits the longer torque arm (relative to the bracing element 60), predominates over the torque m exhibiting a shorter torque arm.

Because the paraffin blocks 21 are driven alternately clockwise and counterclockwise by the described drive belt configuration, the bracing elements 60 constructed as pivot bearings and the bracing elements 61 exhibiting the longitudinal slot 610 of each second paraffining device 2 are also provided in the arrangement illustrated, and the paraffining devices 2 located between them in mirror image arrangement.

In the open-end spinning machine shown, a yarn tension compensating element 7 is located above the bracing elements 60 and 61. As best seen in FIGS. 2 and 3 of the drawings, tension compensating element 7 is positioned in the path of travel of yarn 15. The shape or configuration of element 7 is such as to deflect the thread in such a manner as to equalize the length of its path of travel while it is being traversed by the traversing mechanism for the windup spool 16. In function, the operation of tension compensating element 7 is similar to the tension compensating element 120 disclosed in U.S. Pat. No. 3,690,576. This element partially overhangs the paraffining devices 2. In order to protect the drive belt 3, according to FIGS. 2 and 3, the mutual arrangement of yarn tension compensating element 7 and bracing elements 60 and 61 is made so that these bracing elements 60 and 61 for the return side 31 of the drive belt 3, which is out of engagement with the paraffining device 2, are located close beneath the yarn tension compensating element 7.

In the construction illustrated, the return side 31 of the drive belt 3 is guided in a duct 8 which is open on its side facing the paraffining device 2. This duct 8, which may in principle be of varying construction, is formed, according to the construction illustrated in FIGS. 2 and 3, by the bracket 5 constructed as a retaining plate, an angled section 50 thereof, and a cover bar 70. The cover bar 70 is an integral component of a plate, a further section of which forms the yarn tension compensating element 7 referred to.

Figure 3:
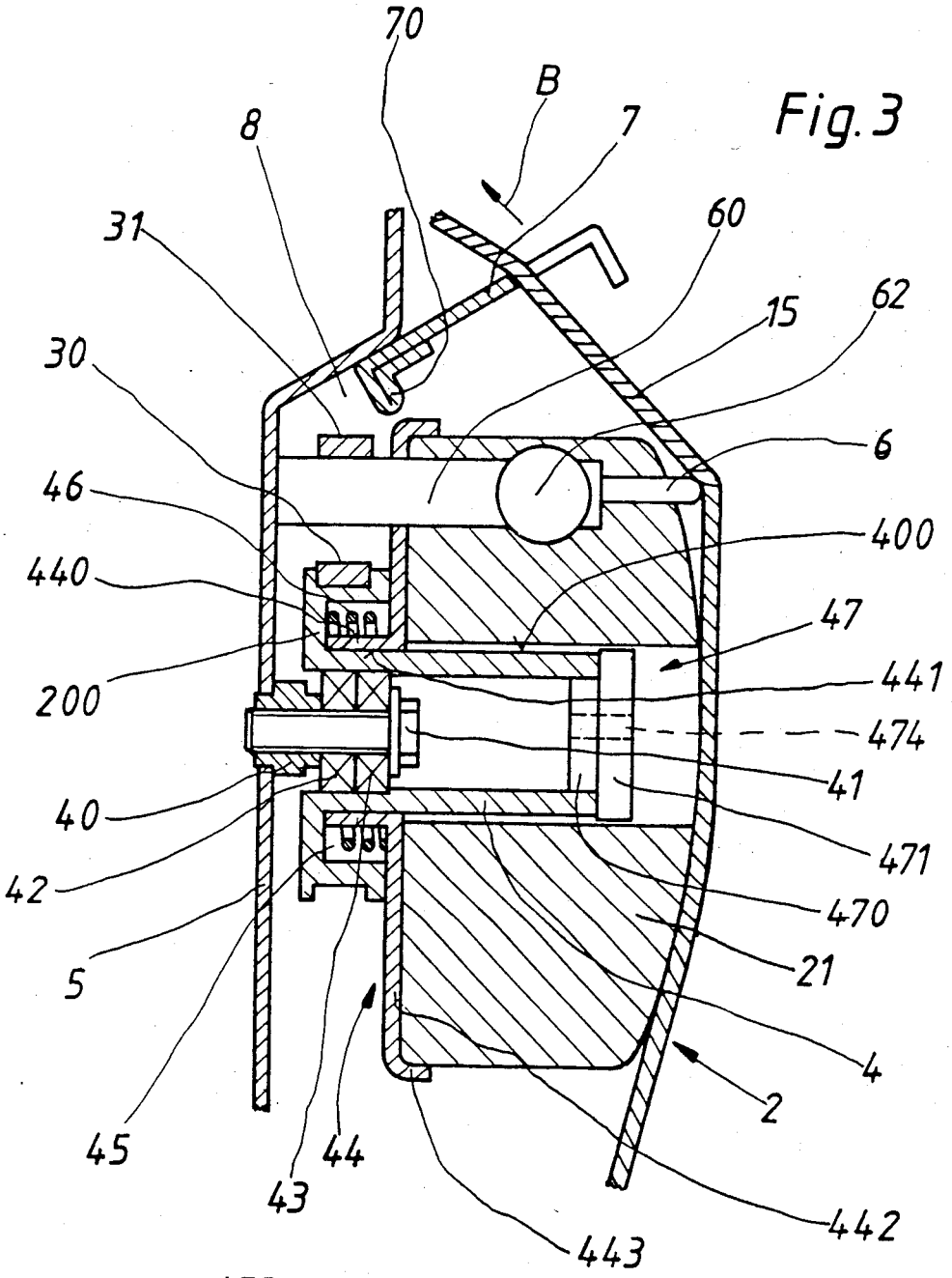
FIG. 3 shows a preferred mode of construction of the paraffining device driven according to the invention in cross-section.

As a comparison of FIGS. 2 and 3 reveals, the drive belt 3 need not necessarily exhibit a flat shape, but may also have a different, for example, round shape. However, the arrangement of the drive whorl 20 between the bracket (retaining plate 5) and the polyhedral bolt 4 with the paraffin block 21 is also not a necessary condition for the drive apparatus.

Figure 5:
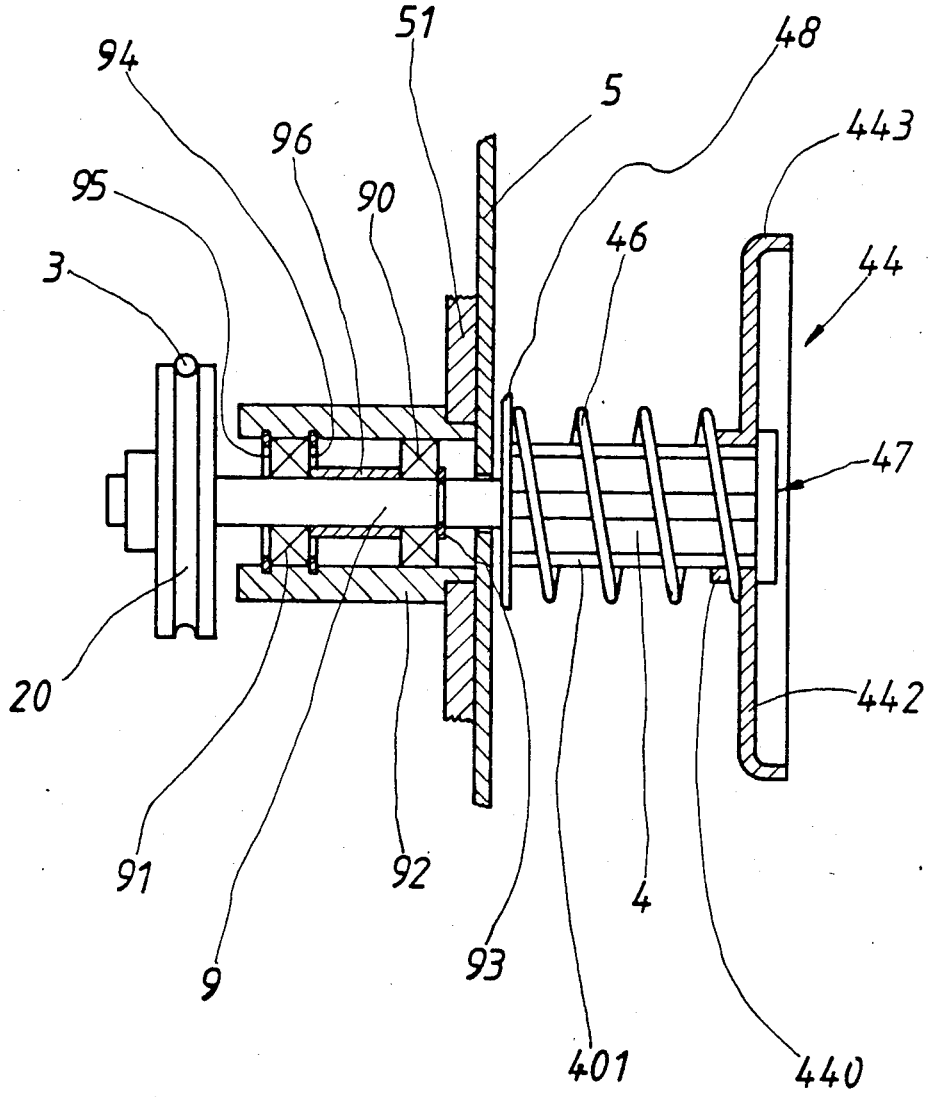
FIG. 5 shows a variant of the paraffining device driven according to the invention in cross-section.

FIG. 5 illustrates a variant drive apparatus, in which the drive whorl 20 is arranged on the one, and the polyhedral bolt 4 with the paraffin support plate 44 on the other side of the bracket 4 reinforced by auxiliary plate 51. The polyhedral bolt 4, which exhibits a bracing plate 48 for the compression spring 46 at its end facing the bracket 5, is mounted integrally in rotation on a shaft 9 in this case. The shaft 9 is mounted in a bearing bushing 92 by means of two rolling-contact bearings 90 and 91. The rolling-contact bearings 90 and 91 are secured axially in the customary manner by circular clips 93, 94 and 95 and a spacing bushing 96. The bearing bushing 92 is pressed into the plate 51. The shaft 9 carries, at its end remote from the polyhedral bolt 4, the drive whorl 20 with which the drive belt 3 is in engagement.

In the case of such a construction, both the driving side 30 and the return side 31 of the drive belt 3 are located behind the bracket 5—considered from the operating side of the machine—so that the drive belt 3 is well protected.

It will be understood, of course, that while the form of the invention herein shown and described constitutes a preferred embodiment of the invention, it is not intended to illustrate all possible forms of the invention. It will also be understood that the words used are words of description rather than of limitation and that various changes may be made without departing from the spirit and scope of the invention herein disclosed.

We claim:

1. A drive apparatus for a paraffining device of a textile machine having a plurality of similar paraffining devices, a plurality of spinning stations on said machine, means for feeding fibers to each of said spinning stations, and a common shaft driving said means for feeding fibers to each of said spinning stations, comprising:

(a) a rotary polyhedral bolt in each device to receive a solid paraffin block against which a yarn to be paraffined is braced;

(b) a drive wheel connected to each polyhedral bolt;

(c) a continuous drive belt in cooperating engagement with the drive wheels in said plurality of adjacent paraffining devices.

(d) means for driving said continuous drive belt from said common shaft so that the supplying of fibers to said spinning stations corresponds directly to the speed of rotation of said paraffin blocks.

2. A drive apparatus as claimed in claim 1, wherein the drive belt is passed zig-zag fashion about the drive whorls of adjacent paraffining devices.

3. A drive apparatus for a parafining device of a textile machine having a plurality of similar paraffining devices comprising:

(a) a rotary polyhedral bolt in each device to receive a solid paraffin block against which a yarn to be paraffined is braced;

(b) a drive whorl connected to each polyhedral bolt;

(c) a continuous drive belt in cooperating engagement with the drive whorls for a plurality of adjacent paraffining devices;

(d) said apparatus being associated with a textile machine constructed as an open-end spinning machine, which textile machine comprises a plurality of mutually juxtaposed open-end spinning apparatuses (apparatuses) and a shaft to control the delivery of (yarn) fibers into said open-end spinning apparatuses, said common drive belt of the paraffining devices being drivingly associated with said shaft.

4. A drive apparatus as claimed in claim 3, which apparatus includes a bracket and wherein the drive whorl of each paraffining device is arranged between said bracket and the paraffin block.

5. A drive apparatus as claimed in claim 4, wherein the polyhedral bolt is constructed integrally with the drive whorl.

6. A drive apparatus as claimed in claim 5, including bearing means and fastening means for the polyhedral bolt and wherein the polyhedral bolt is constructed as a hollow body and accommodates the bearing means and fastening means.

7. A drive apparatus as claimed in claim 6, wherein the fastening means includes a screwthreaded bolt and a screwthreaded bushing in which said screwthreaded bushing is engaged, said bushing being provided in said bracket.

8. A drive apparatus as claimed in claim 7 including a cap and a resiliently stressed paraffin support plate wherein the cavity of the polyhedral bolt is closable at its end remote from the bearing means by said cap which overhangs the external circumference of the polyhedral bolt, said cap being constructed as a stop for said resiliently stressed paraffin support plate, which plate is mounted on the polyhedral bolt.

9. A drive apparatus as claimed in claim 8, wherein the cap includes corners which overhang the polyhedral bolt at its beveled edges, whereas the lateral surfaces of the polyhedral bolt and of the cap are flush, and the paraffin support plate includes guide surfaces adapted to the profile of the polyhedral bolt.

10. A drive apparatus for a paraffining device of a textile machine having a plurality of similar paraffining devices comprising:

(a) a rotary polyhedral bolt in each device to receive a solid paraffin block against which a yarn to be paraffined is braced;

(b) a drive whorl connected to each polyhedral bolt;

(c) a continuous drive belt in cooperating engagement with the drive whorls for a plurality of adjacent paraffining devices;

(d) said apparatus including a bracket, the drive whorl or each paraffining device being arranged between said bracket and the paraffin block;

(e) the drive belt (is) being returned along the driven paraffining devices to a drive station;

(f) (which comprises) said apparatus comprising a bracing element for the return side of the drive belt.

11. A drive apparatus as claimed in claim 10, including a spooling device and a yarn tension compensating element and wherein the parafining device precedes (preceded by) the spooling device (and) which is preceded by the yarn tension compensating element, said element extending from the bracket to above the drive whorl, wherein the bracing element for the return side of the drive belt is arranged close beneath the yarn tension compensating element.

12. A drive apparatus as claimed in claim 10, wherein the bracing element serves as a support for the stop limiting the feed movement of the paraffin block.

13. A drive apparatus as claimed in claim 11, wherein the bracing element is constructed as supports arranged on each side of the paraffin block and the stop extends from one of these supports to the other support.

14. A drive apparatus as claimed in claim 13, wherein one support of the bracing element is arranged on one side of the paraffin block and is constructed as a pivot bearing for the stop, and the other support of the bracing element is located on the other side of the paraffin block and includes a longitudinal slot on its side remote from the paraffining device to receive the stop.

15. A drive apparatus as claimed in claim 14 comprising a duct open on its side facing the parafining device for the return side of the drive belt.

16. A drive apparatus as claimed in claim 15 including a cover bar and wherein the duct is formed by the bracket and said cover bar which is an integral component of the yarn tension compensating element.

17. A method for controlling paraffining devices in an open-end spinning device having a plurality of open-end spinning apparatus and a feeding device for supplying fibers into each of said open-end spinning apparatus, a thread withdrawal means for withdrawing the thread from each of said open-end spinning apparatus and for delivering it to a bobbin device, a rotary solid paraffin block being provided in the thread path between each of said thread withdrawal means and said bobbin device, said method comprising the steps of guiding the thread into contact with said paraffin block, driving said feeding device for supplying fibers into said open-end spinning apparatus from a common shaft, and driving each of said paraffin blocks from said common shaft with a common belt so that the supplying of fibers to said open-end spinning apparatus corresponds directly to the speed of rotation of siad paraffin blocks.

18. A drive apparatus as claimed in claim 3, wherein the drive belt is passed zig-zag fashion about the drive whorl of adjacent paraffining devices.

19. A drive apparatus for a paraffining device of a textile machine having a plurality of similar paraffining device comprising:

(a) a spooling device, said paraffining device preceeding the spooling device;

(b) a rotary polyhedral bolt in each paraffining device to receive a solid paraffin block against which a yarn to be paraffined is braced;

(c) a drive whorl connected to each polyhedral bolt;

(d) a bracket, the drive whorl of each paraffining device being arranged between said bracket and the paraffin block;

(e) a yarn tension compensating element extending from the bracket to above the drive whorl;

(f) a continuous drive belt in cooperating engagement with the drive whorls in said plurality of adjacent paraffining devices which is driven at a drive station and is passed zig-zag fashion about the drive whorls of adjacent paraffining devices and which is returned along the driven paraffining devices to the drive station; and (g) a bracing element for the return side of the drive belt, this bracing element being arranged close beneath the yarn tension compensating element, 20. A drive apparatus as in claim 19, wherein the bracing element serves as a support for the stop limiting the feed movement of the paraffin block, 21. A drive apparatus as claimed in claim 20, wherein the bracing relement is constructed as supports arranged on each side of the paraffin block and the stop extends from one of these supports to the other support.

22. A drive apparatus as claimed in claim 21, wherein one support of the bracing element is located on the other side of the paraffin block and includes a longitudinal slot on its side remote from the paraffining device to receive the stop.

23. A drive apparatus as claimed in claim 22 comprising a duct open on its side facing the paraffining device for the return side of the drive belt.

24. A drive apparatus as claimed in claim 23 including a cover bar and wherein the duct is formed by the bracket and said cover bar which is an integral component of the yarn tension compensating element.

25. A drive apparatus as claimed in claim 19 wherein said apparatus is associated with a textile machine constructed as an open-end spinning machine, which textile machine comprises a plurality of mutually juxtaposed open-end spinning apparatuses and a shaft to control the delivery of yarn into said open-end spinning apparatuses, said common drive belt of the paraffining devices being drivingly associated with said shaft.

* * * * *